US005172538A

United States Patent [19]

Luger

[11] Patent Number: 5,172,538

[45] Date of Patent: Dec. 22, 1992

[54] STIRRUP PAD

[76] Inventor: Linda S. Luger, 2500 N. 6th St., Burbank, Calif. 91504

[21] Appl. No.: 755,090

[22] Filed: Sep. 5, 1991

[51] Int. Cl.[5] ..... B68C 3/00

[52] U.S. Cl. ..... 54/47

[58] Field of Search ..... 54/47, 48, 46

[56] References Cited

U.S. PATENT DOCUMENTS

| | | | |
|---|---|---|---|
| 222,556 | 12/1879 | Whitman | 54/47 |
| 223,577 | 1/1880 | Brower | 54/47 |
| 1,639,073 | 8/1927 | Berbaum | 54/47 |
| 1,991,648 | 2/1935 | Armentrout | 54/48 |
| 2,187,983 | 1/1940 | Moore | 54/47 |

FOREIGN PATENT DOCUMENTS

| | | | |
|---|---|---|---|
| 2123071 | 12/1971 | Fed. Rep. of Germany | 54/47 |
| 355682 | 9/1961 | Switzerland | 54/47 |
| 14186 | of 1907 | United Kingdom | 54/47 |
| 754199 | 8/1956 | United Kingdom | 54/47 |

*Primary Examiner*—Gene Mancene
*Assistant Examiner*—Todd E. Manahan
*Attorney, Agent, or Firm*—John E. Wagner

[57] ABSTRACT

The stirrup pad of the present invention includes a ramp or inclined footrest designed to support a foot resting thereupon in an angled orientation characterized by the toes being above the heel. The top surface of the ramp or inclined footrest includes a friction surface to grip a foot resting thereupon. The bottom portion of the stirrup pad is adapted for removable engagement with a stirrup. The use of the present invention allows a saddle occupant, while riding, to maintain an angled foot orientation with the heel angled downwardly, thus achieving a safer, more comfortable, and more stylish riding form.

14 Claims, 2 Drawing Sheets

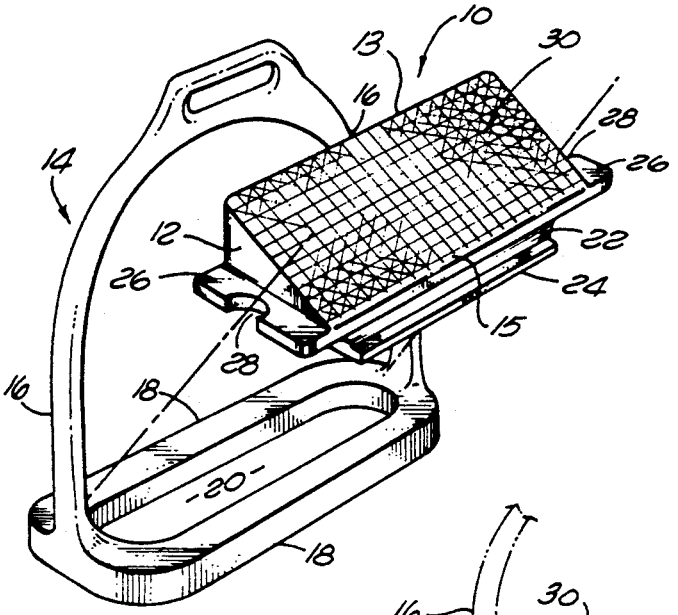
FIG. 1
FIG. 2
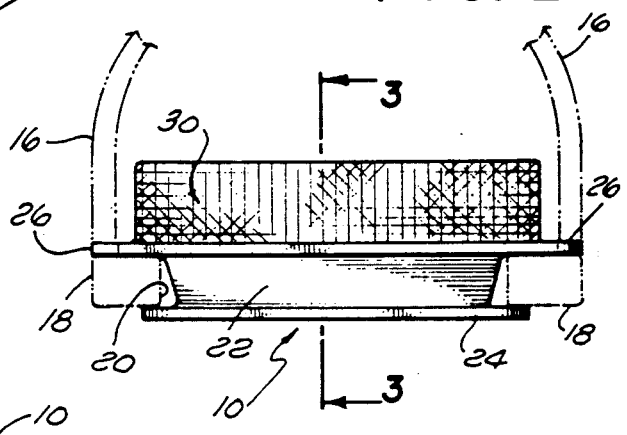
FIG. 3
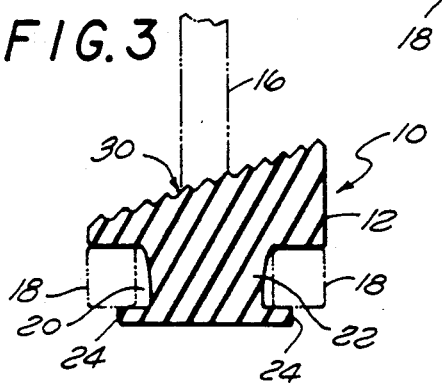
FIG. 4
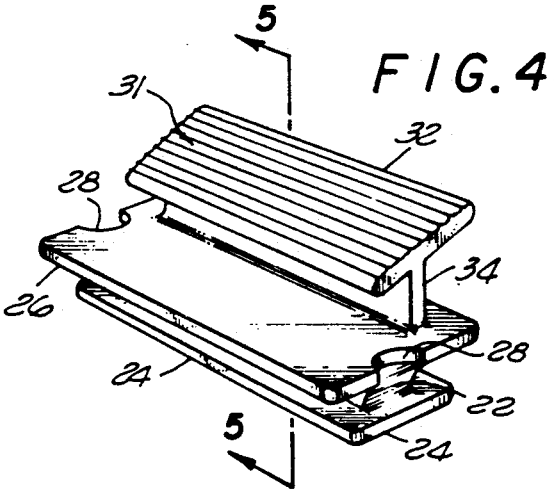
FIG. 5
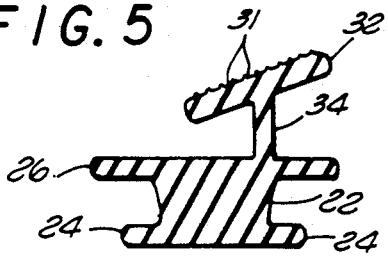

STIRRUP PAD

BACKGROUND OF THE INVENTION

This invention relates to stirrup pads, also known as tread pads, for stirrups associated with saddles for riding purposes. More particularly, this invention relates to an improved stirrup pad configured to help a saddle occupant maintain a safer, more stable, and more stylish (in terms of riding form) mount upon a saddled animal.

Stirrup pads are well known, as demonstrated by U.S. Pat. Nos. 1,639,073 and 2,187,983. Generally, prior stirrup pads provide a rest, or foothold, that attaches to a saddle stirrup, thereby materially increasing the foot-bearing surface of the stirrup. Typically, stirrup pads include an upper, foot-supporting surface having a tread or friction-inducing portion for preventing the rider's foot from slipping out of the stirrup associated with the stirrup pad. Conventionally, the bottom portion of past stirrup pads is configured to provide for removable engagement with a stirrup. Stirrup pads are intended to help a rider maintain a saddled mount in a stable, safe manner.

However, conventional stirrup pads are not currently designed to provide for the maximum advantages which can be incorporated therein. Specifically, there exists a need for an improved stirrup pad which is configured to optimize the comfort of a saddle occupant, while simultaneously helping the rider to maintain a more stylish riding form (the focus of horse shows, for example) using proper technique. Preferred riding technique involves proper foot orientation within the saddle stirrup. A horse rider, for example, is taught to keep his (or her) heels down; that is, to orient the foot within the stirrup such that the foot is angled with the heel down, i.e. positioned lower than the upwardly angled toes of the foot. This preferred orientation has the rider's feet angled at a slant characterized by approximately an angle of between thirty and sixty degrees, with the rider's heels pointing towards the ground and the rider's toes facing substantially skywardly. Such foot positioning, within the stirrup atop the associated stirrup pad, is preferred because it provides for a more stable mount within the associated saddle, with better balance and proper weight distribution for the rider. Unfortunately, conventional, prior stirrup pads do not provide means for maintaining the rider's foot in this preferred angled orientation, Thus, there also exists a need for an improved stirrup pad having means for angling a rider's foot at a proper, preferred angle within the stirrup.

Currently, the rider must maintain a proper technique foot orientation without much help from a conventional stirrup pad; the sought-after angled orientation previously was achieved solely by the manner in which the rider positioned his or her feet within the stirrups. Achievement and maintenance of proper foot positioning within a saddle stirrup is too important a detail to leave solely to the responsibility of the rider, with no aid from the riding equipment, because proper foot positioning has safety implications as well. Specifically, an angled foot orientation within the stirrup, with the heel positioned at a height lower than the toes, prevents the foot from inadvertently and undesirably passing through the loop-like opening defined by a conventional stirrup. Such a scenario disadvantageously usually results in the rider's foot getting caught or hung up within the stirrup. This can have disastrous consequences if the rider should fall from the saddle mount because, with the rider's foot or feet trapped in the stirrup(s), the fallen rider will be dragged by the saddled horse, a situation often causing injuries to the rider and/or animal. Thus, there exists a need for an improved stirrup pad designed to maintain an angled foot orientation for safety reasons, to prevent a rider's feet from getting captured within either stirrup, thereby preventing a fallen rider from being dragged. An angled foot orientation allows the foot to easily slip out of a stirrup as a rider is dismounting (or is accidentally falling) from the saddle.

Moreover, there exists a need for an improved stirrup pad that can be used as a training aid to help new riders learn to maintain the proper foot orientation within a stirrup for the reasons of safety, style, and comfort noted above. Such a needed, improved stirrup pad should be of a simplified, inexpensive construction designed for durability, and should be removably attachable to a stirrup without requiring the use of tools or auxiliary parts or fasteners. The present invention fulfills these needs and provides further related advantages.

BRIEF DESCRIPTION OF THE DRAWINGS

The accompanying drawings illustrate the invention. In such drawings:

FIG. 1 is a perspective view of a stirrup pad embodying the invention, showing the orientation of the stirrup pad prior to its attachment to a stirrup, also showing a stirrup pad having an angled upper body and grooved flanges for interlocking with upstanding arms of the stirrup;

FIG. 2 is a front elevation view of the stirrup pad of FIG. 1, showing the orientation of the stirrup pad while attached to the stirrup (with said stirrup being shown in fragmentary phantom outline), and also showing the manner in which a bottom portion of the stirrup pad interlocks with the base of a stirrup;

FIG. 3 is a cross-sectional view of the stirrup pad of FIGS. 1 and 2, taken generally on line 3—3 of FIG. 2, illustrating the manner in which the bottom portion of the stirrup pad interlocks with the stirrup (shown in fragmentary phantom outline) and also illustrating an integrally formed rough, angled upper surface of the stirrup pad;

FIG. 4 is a perspective view of another preferred embodiment of the inventive stirrup pad, wherein the angled upper body of this stirrup pad embodiment is defined by a substantially vertically oriented stem wall having an angled, generally planar footrest portion integrally formed at its top end;

FIG. 5 is a cross-sectional view of the stirrup pad of FIG. 4, taken generally on line 5—5 of FIG. 4, illustrating a bottom portion of the stirrup pad which is similar to the corresponding portion in FIGS. 1–3, and also showing a rough upper surface on the angled footrest portion;

DETAILED DESCRIPTION OF THE PREFERRED EMBODIMENTS

Figure 6:
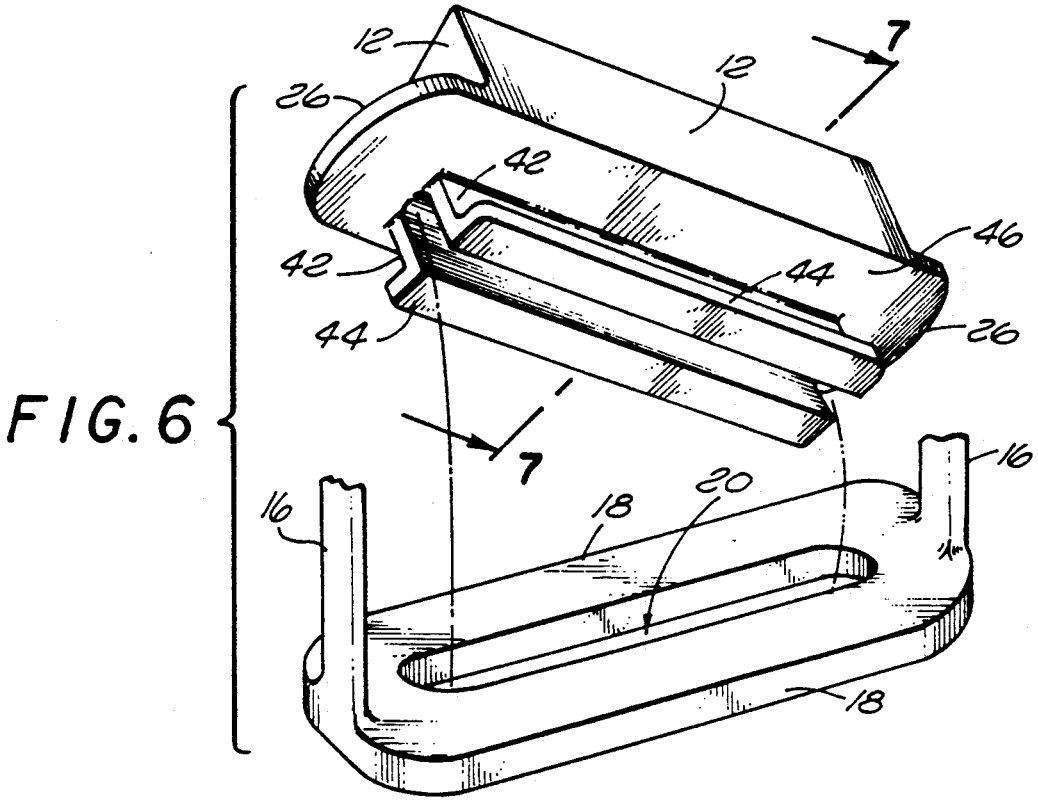
FIG. 6 is a perspective view of an improved stirrup pad having a third embodiment characterized by a bottom portion that is configured differently than in FIGS. 1–5, said bottom portion comprising a pair of downwardly extending runners, each having an outwardly projecting flange extending therefrom, also depicting the manner in which the bottom portion fits within a central opening defined in the base of a stirrup (shown in fragment)

As shown in the drawings for purposes of illustration, the present invention resides in an improved stirrup pad 10 (FIG. 1) having an advantageously angled ramp portion 12 defined by the upper body of the pad. The ramp portion 12 maintains a foot resting upon the stirrup pad 10 in an angled orientation, thereby aiding the rider in achieving a riding form that importantly, is safer (due to both improved stability of mount, resulting from the better balance and proper weight distribution associated with angling the rider's foot within the stirrup, and due to the fact that the angled foot orientation maintained by the present invention, with toes angled upwardly and the heel angled downwardly, is safer because a fallen rider is unlikely to end up with a foot caught within a stirrup, and thus, is unlikely to get dragged by a stirrup after falling). Moreover, the angled foot orientation imparted by the present invention to a foot resting upon the ramp portion 12 advantageously facilitates a riding form that is both more comfortable and more stylish (in terms of proper technique as recognized by equestrian judges) for the user. Further, the inventive stirrup pad 10 beneficially provides a training aid that helps condition a rider to maintain the desired angled foot orientation while mounted in the saddle and stirrups. In this latter case, the rider can learn proper foot orientation within a stirrup (with the heel angled downwardly) so that such technique can later be exhibited even in the absence of the inventive stirrup pad which aids the user in maintaining this foot stance.

The inventive stirrup pad 10 is adapted for removable engagement with a conventional stirrup 14. Beneficially, this engagement is achieved without requiring the use of tools or auxiliary fasteners. Typically, a conventional stirrup 14 comprises a pair of upwardly extending yoke arms 16 that join together. The yoke arms 16 extend from an elongated stirrup frame 18 having a central elongated opening 20. The yoke arms 16 and the stirrup frame 18 cooperatively define a loop (not the central opening 20) within which a rider's foot could get captured, if the rider were using a conventional stirrup pad. Fortunately, with the improved stirrup pad 10, the chance of a rider's foot getting captured within the loop defined by a conventional stirrup is unlikely, because the ramp portion 12 angles a foot resting thereupon in an orientation which would incline the foot to slide out of engagement with the stirrup, if desired, rather than into entanglement within the described stirrup "loop".

The stirrup pad 10 has a main body comprised of a durable material, preferably rubber or hard plastic. The stirrup pad body is adapted to rest flat upon the stirrup frame 18, when engaged therewith, in the manner shown in FIG. 2. To achieve interlocking engagement with the stirrup frame 18, a bottom portion 22 of the stirrup pad body is sized and configured to fit within the central opening 20 in a stirrup 14. The bottom portion 22 may be tapered for a snug fit within the stirrup opening 20. The bottom portion 22 of the stirrup pad 10 includes an outwardly projecting lower rim 24 that can be provided around the entire perimeter of the bottom pad portion 22 (as in FIG. 4) or at only selected perimeter areas of said bottom pad portion 22 (as in FIG. 1). As best seen in FIGS. 2 and 3, the lower rim 24 of the bottom pad portion 22 engages beneath the stirrup frame 18 to interlock said bottom pad portion 22 within the stirrup opening 20. When the stirrup pad 10 is engaged with the stirrup 14 in this manner, the underside of the ramp portion 12, as well as flange portions 26, of the stirrup pad 10 will rest flush atop the stirrup frame 18. To accommodate insertion and engagement of the bottom pad portion 22 and the lower rim 24 within the stirrup opening 20, these stirrup pad elements may be made of a flexible hard rubber or other material having at least a slight degree of resiliency.

Figure 8:
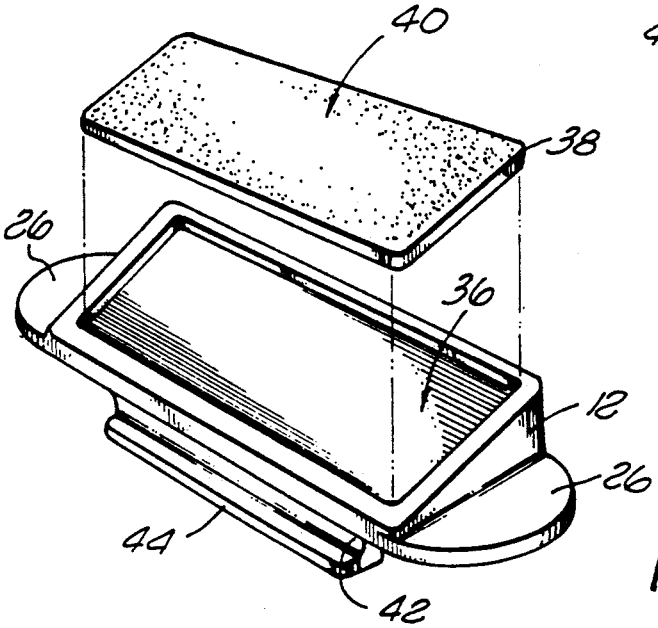
FIG. 8 is another perspective view of the stirrup pad of FIGS. 6 and 7, showing a rough top surface which is provided by a substantially planar insert that fits into engagement atop the stirrup pad, also illustrating a recessed top portion of the stirrup pad which is configured to accommodate said insert.

The ramp portion 12 of the stirrup pad 10 has outwardly projecting flange portions 26 extending from opposite ends (and/or sides) thereof. In other terms, it can be said that the flange portions 26 extend outwardly from upper areas of the bottom pad portion 22. These flange portions 26 can extend from opposite ends of the ramp portion 12 (or the bottom portion 22, depending upon your perspective) as in FIGS. 1 and 2, or can extend around the entire upper perimeter of the bottom pad portion 22, as in FIGS. 4 and 5. The location on the stirrup pad body from which these flange portions 26 extend may also be characterized as being between the ramp portion 12 and the bottom pad portion 22, or where these two portions 12 and 22 meet. Side flange portions 26 may include a groove or notch 28 that encompasses and accommodates the stirrup yoke arms 16 when the stirrup pad 10 is engaged with a stirrup 14. The engagement of a stirrup arm 16 within a stirrup pad notch 28 provides further means for interlocking the stirrup pad 10 with the stirrup 14. Note that FIGS. 6 and 8 present an alternative embodiment of the inventive stirrup pad, in which the flange portions 26 do not include any notches 28. In this embodiment, the flange portions 26 are sized small enough so as to not abut with the stirrup yoke arms 16 when the stirrup pad is attached to the stirrup. All of the embodiments presented herein may have either the smaller flange portions of FIGS. 6 and 8 or the notched flange portions of FIGS. 1 and 4.

The entire body of the stirrup pad 10 may be manufactured as a single piece of molded rubber. The ramp portion 12 has a rough upper surface 30 that can be characterized as a tread for preventing a foot resting upon the ramp portion 12 (specifically its rough surface 30) from slipping off. The rough upper surface 30 can be provided in any number of ways, such as providing a plurality of longitudinal slots, tiny depressions, or miniature protrusions on the upper ramp surface 30. The main guideline is to provide the top surface 30 of the ramp portion 12 with a contour that allows a friction grip for the rider's foot upon the stirrup pad of the present invention. Some alternative ways of achieving this friction grip are illustrated in the other embodiments of the inventive stirrup pad. The ramp portion 12 is bounded by an upper most ramp edge 13 and a lowermost ramp edge 15 (see FIG. 1) that are oriented substantially parallel to the horizontally oriented main body of the stirrup 14 and the stirrup frame 18. The embodiment of FIGS. 4 and 5 utilizes longitudinal grooves 31 in the top surface of a footrest 32 which is supported by a stem wall 34.

The footrest 32 and stem wall 34 provide an alternative means for angling a foot resting upon the stirrup pad. That is, the footrest 32 (comprising a thin, substantially planar, rectangular member) and the stem wall 34 are functionally equivalent to (and thus are an alternative substitute for) the ramp portion 12 of FIGS. 1 and 2 in that both provide means for angling the rider's foot in the proper orientation. The stem wall 34 should be strong enough to support the weight of the rider's foot upon the footrest 32. The view shown in FIG. 5 (cross-sectional view) illustrates that the stem wall 34 and the footrest 32 define a substantially "T" shaped configuration, with the exception that the footrest 32 is oriented at an angle (preferably between 30 and 60 degrees relative to horizontal) relative to the stem wall 34, rather than being oriented perpendicularly thereto, as would be the case in a precise "T" shape. The ramp portion 12 is also preferably slanted at an angle of between thirty and sixty degrees relative to horizontal. The ramp portion 12 and the footrest 32 are but two ways that the inventive stirrup pad can be configured to provide means for angling a foot supported atop the stirrup pad. It will be apparent to those skilled in the art that many alternatives to the embodiments disclosed herein exist, and other stirrup pads embodied to provide means for angling a foot supported thereby, are considered to fall within the scope of this patent.

Figure 7:
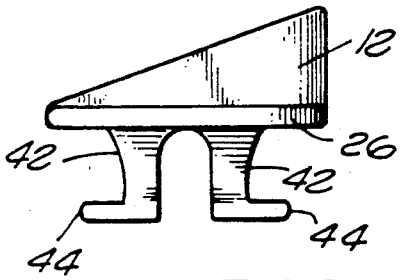
FIG. 7 is a side elevational view of the stirrup pad of FIG. 6, said view being taken generally along line 7—7 of FIG. 6, and showing the angled upper portion of the stirrup pad.

Other alternatives are illustrated in FIGS. 6–8. FIG. 8 depicts a ramp portion 12 having a recessed area 36 that accommodates an insert 38 having a rough top surface 40. The insert 38 may be retained within the recessed area 36 by a snap-fit or other conventional means, such as glue. Thus, the friction top surface of the ramp portion 12 may be integrally formed therewith, as in FIG. 1, or may be provided by an insert 38. The insert 38 may provide a foothold or gripping function by employing corrugations, ridges, bristles, various tread designs, etc.

FIGS. 6 and 7 allow for the best view of an alternative configuration of the bottom pad portion (differing from FIGS. 15). In this embodiment, the stirrup pad has two elongated, longitudinal runners 42 having outwardly extending flanges 44 projecting therefrom. These runners 42 project downwardly from an underside surface 46 of the ramp portion 12. When the runners 42 are inserted within a stirrup opening 20 (see FIG. 6), the flanges 44 will interlock with the stirrup frame 18 in the same manner that the lower rim 24 interlocks with the stirrup frame in FIGS. 2 and 3. Note that the flanges 44 extend in opposite directions and are oriented substantially perpendicular to the runners 42. The runners 42 and the flanges 44 may be flexible to facilitate their engagement within a stirrup opening 20. The runners 42 and the flanges 44, as well as the bottom pad portion 22 and its lower rim 24, provide means for preventing the improved stirrup pad from being accidentally separated from the stirrup 14 by interlocking the stirrup pad and stirrup.

While several particular forms of the invention have been illustrated and described, it will also be apparent that various modifications can be made without departing from the spirit and scope of the invention. Accordingly, it is not intended that the invention be limited, except as by the appended claims.

I claim:

1. For use with a stirrup having an elongated stirrup frame for supporting a rider's foot, said frame being oriented substantially horizontally, a stirrup pad comprising a body member including a base for attaching said stirrup pad to said stirrup, said base also being oriented substantially horizontally on said stirrup frame, said body member also having a footrest portion, including a foot engaging ramp attached to said base, said ramp comprising a surface sloped from front to rear only and having at least a lower ramp edge which is essentially parallel to said stirrup frame, wherein said footrest portion serves to orient a foot supported by said footrest portion at an angle relative to horizontal.

2. A stirrup pad as set forth in claim 1, wherein the sloped surface of said ramp includes a foot-engaging surface having a tread thereon.

3. A stirrup pad as set forth in claim 1, wherein the sloped surface of said ramp portion includes a recess therein, and wherein said recess accommodates an insert that provides a friction exterior surface.

4. A stirrup pad as set forth in claim 1, wherein said base includes a flange configured for engagement with said stirrup frame.

5. A stirrup pad as set forth in claim 1, wherein said body member is comprised of rubber and wherein said base and said footrest portion of said body member are integrally formed.

6. A stirrup pad as set forth in claim 1, wherein said ramp is oriented at an angle of between 30 and 60 degrees, inclusive, relative to horizontal.

7. A stirrup pad as set forth in claim 6, wherein said inclined surface is oriented at an angle of approximately 45 degrees relative to horizontal.

8. A stirrup pad comprising a body member having means for attaching said stirrup pad to a stirrup frame, said body member also having a footrest portion, wherein said footrest portion provides means for angling a foot supported on said stirrup pad, wherein said angling means serves to orient a foot supported by said footrest portion at an angle relative to horizontal, and wherein said footrest portion comprises a body having an essentially planar surface supported substantially parallel to said stirrup frame and at an angle relative to horizontal by a stem wall that projects outwardly from a top surface of said body member.

9. A stirrup pad as set forth in claim 8, wherein said top surface of said body member defines a substantially planar surface, and wherein said stem wall projects from said top surface such that said wall is substantially perpendicular relative to said top surface.

10. A stirrup pad as set forth in claim 8, wherein said planar body comprising said footrest portion is substantially rectangular in shape.

11. A stirrup pad as set forth in claim 8, wherein said planar body includes a top surface having tread, thereon.

12. For use with a stirrup having an elongated stirrup frame for supporting a rider's foot, said frame being oriented substantially horizontally, and a pair of generally vertically oriented yoke arms supporting said stirrup frame, a stirrup pad comprising a body member including a base for attaching said stirrup pad to said stirrup, said base being oriented horizontally on said stirrup frame;

said body member also including a footrest portion including a foot engaging ramp attached to said base, said ramp comprising a surface sloped form front to rear only and having at least a lower ramp edge which is essentially parallel to said stirrup frame;

one of said base and said footrest portion including notches engaging said yoke arms;

wherein said footrest portion serves to orient a foot supported by said footrest portion at an angle relative to horizontal.

13. A stirrup pad as set forth in claim 12 wherein said stirrup frame includes an elongated central opening and said base includes a bottom portion contoured to fit in said central opening and an outwardly projecting lower rim engaging said stirrup frame to fasten said stirrup pad to said stirrup frame.

14. A stirrup pad as set forth in claim 12 wherein the surface of said foot engaging ramp incorporates a tread to provide a friction grip for a rider's foot.

* * * * *